United States Patent [19]

Pregozen et al.

[11] Patent Number: 4,559,151

[45] Date of Patent: Dec. 17, 1985

[54] ANTISTATIC FABRIC CONDITIONER COMPOSITIONS AND METHOD

[75] Inventors: David Pregozen, Park Ridge; John J. Hiller, Jr., Old Tappan, both of N.J.

[73] Assignee: Sterling Drug Inc., New York, N.Y.

[21] Appl. No.: 608,000

[22] Filed: May 7, 1984

[51] Int. Cl.[4] ..... D06M 11/00

[52] U.S. Cl. ..... 252/8.8; 252/547

[58] Field of Search ..... 252/8.8, 547, 542; 427/242

[56] References Cited

U.S. PATENT DOCUMENTS

| | | | |
|---|---|---|---|
| 2,153,358 | 4/1930 | Whitehead | 427/439 |
| 3,447,948 | 6/1969 | Koch | 428/505 |
| 3,625,891 | 12/1971 | Waldman et al. | 252/8.8 |
| 3,650,816 | 3/1972 | Rudy et al. | 427/11 |
| 3,696,078 | 10/1972 | Smith et al. | 524/121 |
| 3,756,950 | 9/1973 | Gluck | 252/8.75 |
| 3,775,316 | 11/1973 | Berg et al. | 252/8.8 |
| 3,806,359 | 4/1974 | McLaughlin | 427/242 |
| 3,959,155 | 5/1976 | Montgomery et al. | 252/8.8 |
| 3,963,629 | 6/1976 | McLaughlin | 252/8.8 |
| 4,012,326 | 3/1977 | Rudy et al. | 252/8.8 |
| 4,075,110 | 2/1978 | Duffin | 252/8.8 |
| 4,129,505 | 12/1978 | Dasher et al. | 252/8.8 |
| 4,168,302 | 9/1979 | Schoenberg | 424/70 |
| 4,237,155 | 12/1980 | Kardouche | 427/242 |
| 4,327,133 | 4/1982 | Rudy et al. | 427/242 |
| 4,389,448 | 6/1983 | Green | 428/195 |
| 4,392,965 | 7/1983 | Woodward et al. | 252/8.8 |
| 4,401,578 | 8/1983 | Verbruggen | 252/8.8 |
| 4,427,558 | 1/1984 | David | 252/8.8 |

FOREIGN PATENT DOCUMENTS

| | | | |
|---|---|---|---|
| 913309 | 10/1972 | Canada | 252/8.8 |
| 2166494 | 6/1974 | Fed. Rep. of Germany . | |

*Primary Examiner*—Prince E. Willis
*Assistant Examiner*—Willie J. Thompson
*Attorney, Agent, or Firm*—William G. Webb; B. Woodrow Wyatt; Paul E. Dupont

[57] ABSTRACT

Antistatic and fabric softener compositions for application to textile fabrics comprises a combination of an N,N-dialkyl-N,N-di-lower-alkyl quaternary ammonium salt either alone or in combination with an N-long-chain alkylamido-lower-alkyl-N,N-di-lower-alkyl-N-$R_4$'-quaternary ammonium salt and critical amounts of a lactic acid salt and the method of use of such compositions for treating textile fabrics.

15 Claims, No Drawings

ANTISTATIC FABRIC CONDITIONER COMPOSITIONS AND METHOD

BACKGROUND OF THE INVENTION (a) Field of the Invention

This invention relates to textile fabric treatment compositions for application to textile fabrics, which reduce electrostatic charge on said fabrics and which improve the "feel" thereof, and to a method of use of such compositions for such purpose.

(b) Information Disclosure Statement

It is known that textile fabrics prepared from fibers which have a high dielectric constant and a low electrical conductivity are highly susceptible to the development of an electrostatic charge on the fabrics particularly in a dry atmosphere. (See for example Whitehead U.S. Pat. No. 2,153,358.) The development of such electrostatic charge in garment fabrics causes the garments to display an undesirable tendency to cling to the wearer rather than to adopt a more natural and comfortable drape on the wearer's body. The problem of electrostatic charge build up on fabrics is particularly acute in dry weather, apparently because any inherent electrical conductivity the fabrics may possess, which would tend to dissipate static charge, is diminished considerably under such dry conditions. (See for example Dasher et al. U.S. Pat. No. 4,129,505.)

There have been several general approaches by the prior art to the solution of the problem. In one approach, attempts have been made to essentially permanently increase the electrical conductivity of spun fibers by incorporation of various ionic species either within the structure of the fibers or as a coating thereon during the spinning process. Thus in the above noted U.S. Pat. No. 2,153,358, the spun fibers, such as cellulose esters or ethers, are either coated with, or are spun so as to incorporate within the fibers, a variety of electrolytes. In Smith et al. U.S. Pat. No. 3,696,078, the problem is addressed by the incorporation within spun nylon fibers of certain phosphonium bromides in combination with certain polyalkoxylated agents. The method is said to have an advantage over previous methods in which polyalkoxylated agents are used to provide an antistatic effect, because the antistatic properties of spun fibers treated with the phosphonium bromide/polyalkoxylated agent combination are stable to subsequent rinsing or washing of the fabrics with which those agents are incorporated.

In another approach, a composition containing an antistatic agent is either formulated as part of a laundry detergent composition or is added as a separate composition to a laundry wash cycle. Thus Montgomery et al. U.S. Pat. No. 3,959,155 describes "fabric softener and antistatic compositions" for combination with a detergent, containing a "softening component comprising a smectite clay", an "antistatic component" comprising "a quaternary ammonium compound" and "an electrically conductive salt" of aluminum or lithium dispersed therein. Woodward U.S. Pat. No. 4,392,965 describes a fabric softener/antistatic composition containing a water insoluble quaternary ammonium salt, for example an N,N-dialkyl-N,N-di-lower-alkylammonium salt wherein the anion is derived from an organic carboxylic acid. The insoluble quaternary ammonium salts are said to be compatible with anionic laundry detergents and are intended to be added, as separate ingredients, to a laundry wash cycle.

Alternatively, and more conventionally, the antistatic agent is applied to laundered fabrics in a clothes dryer during the drying cycle. Thus Rudy U.S. Pat. No. 3,650,816 describes an additive for application to clothes in a dryer for imparting both fabric softening and antistatic properties to fabrics. The compositions are formulated as aerosol sprays which, when sprayed onto the drum of a laundry dryer, form a hard surfaced coat which is then uniformly transferred to the fabrics as they are tumbled over the drum surface during a drying cycle. Kardouche U.S. Pat. No. 4,237,155 describes fabric softener/antistatic compositions containing, as the softener/antistatic agent, a tertiary amine salt produced by the reaction of a tertiary amine with a carboxylic acid. The compositions may optionally contain cationic softener/antistatic agents, such as quaternary salts of the N,N-di-long chain-N,N-di-lower-alkylammonium type, such as an N,N-ditallow-N,N-dimethylammonium chloride (or methosulfate). The compositions are applied to fabrics during a drying cycle either from a sponge, from a paper impregnated with the composition or by spraying from an aerosol can into the dryer.

Other means of uniformly distributing fabric conditioners of various kinds over fabrics in a clothes dryer involve use of a so-called distributing agent, as illustrated by Rudy et al. U.S. Pat. No. 4,012,326 which describes a fabric softener composition containing a distributing agent, e.g., ammonium carbonate, which volatilizes at temperatures encountered in a dryer thus helping to spread the composition throughout the mass of the fabrics in the dryer. The Rudy et al. compositions are intended to be added to the clothes dryer at the beginning of a drying cycle while the clothing is still wet. The distributing agent used in the compositions therefore can also comprise a hydroxycarboxylic acid, such as citric, tartaric or gluconic acid, which is soluble in the water accompanying the wet wash. The acids, because of their acidity, promote the solubilization and spreading of cationic fabric softeners. The softeners so employed include, for example, N,N-distearyl-N,N-dimethylammonium chloride.

German Application No. 2,166,494 describes antistatic compositions for spray application in carpet shampoo, floor cleaning or domestic cleaning formulations, containing, as the effective antistatic agent, an ammonium, alkali metal or alkaline earth metal salt of carboxylic acids containing from two to eight carbon atoms which can contain a hydroxy group. Of the latter type of salt, sodium and ammonium glycolate are specifically mentioned as being effective. Salts of lactic acid, although within the ambit of the generic disclosure, are not specifically mentioned, but in any case as will be demonstrated hereinafter, we have found sodium lactate to be completely ineffective as an antistatic agent when applied as a spray to textile fabrics.

Still another approach to the problem of solving the static cling problem in wearing apparel involves application of an antistatic composition to the fabrics in an essentially anhydrous environment. Thus McLaughlin U.S. Pat. No. 3,806,359 describes a fabric softener composition which is dispensed as a foam from a pressurized aerosol container onto clothing in a dryer which is then subjected to tumbling in the dry heat of the dryer. Dasher et al. U.S. Pat. No. 4,129,505 describes an antistatic composition for direct application to dry clothing which comprises a quaternary ammonium fabric softener and ammonium acetate in ethanol in a pressurized aerosol formulation which is sprayed onto the clothing. The ammonium acetate is said to act in cooperation with the fabric softener, because the former is hygroscopic and deliquescent and thus picks up sufficent moisture from the atmosphere to help maintain the ionic character of the quaternary. The composition thereby increases the electrical conductivity of the fabrics to which it is applied thus lessening the static charge.

It is thus seen that, although quaternary ammonium salts, such as quaternaries of the N,N-di-long chain-N,N-di-lower-alkylquaternary ammonium type, have been known to function both as fabric softeners and as antistatic agents, the antistatic properties inherent in their ionic nature are generally lost, or at least ineffectively utilized, unless the fabric softener/antistatic agents are formulated or used in some particular way which fixes the agents either to or within the molecular framework of the fabric substrate with which they are associated; or unless means are adopted which help to more thoroughly spread the agents throughout the mass of the textile fabrics to which they are applied; or unless other ingredients are used to maintain an essentially permanently moist environment for the agents.

We have surprisingly found that, when quaternary ammonium salts of the N,N-dialkyl-N,N-di-lower-alkylammonium type are formulated with certain relative amounts of a lactic acid salt, the formulations, when applied to fabrics, impart antistatic properties to the fabrics at concentrations at which the quaternary salts alone impart either significantly less effective antistatic properties or none at all. This enhanced antistatic effect of the combination of lactic acid salt and quaternary ammonium salt thus permits the use of the latter at concentrations significantly lower than otherwise possible while still maintaining antistatic effectiveness, a factor which not only has the advantage of reducing cost, but also of minimizing any undesired effects which the use of larger quantities of the quaternary ammonium salts may have on the treated fabrics, e.g. adverse changes in "feel" or "hand", or loss of absorbency or discoloration.

This finding is quite unexpected, because to our knowledge lactic acid salts have not been used to provide antistatic effects in textile fabrics and, in fact as stated above, experiments carried out by us with sodium lactate have established the latter salt per se to be completely ineffective as an antistatic agent when applied to textile fabrics in the form of a spray at concentrations at which they are employed in this invention, this notwithstanding the fact that salts of lactic acid are disclosed in the prior art to produce an antistatic effect on non-fibrous cellulosic plastic sheets which have been impregnated therewith (see Koch U.S. Pat. No. 3,447,948).

SUMMARY OF THE INVENTION

Thus in a composition of matter aspect, the invention provides antistatic and fabric softening compositions intended for application to textile fabrics, which compositions comprise a combination of an N,N-dialkyl-N,N-di-lower-alkylquaternary ammonium salt and a salt of lactic acid, a carrier for said combination, and optionally other ingredients.

In a method aspect, the invention provides a method of reducing or inhibiting the accumulation of electrostatic charge on textile fabrics which comprises applying said combination of quaternary ammonium salt and lactic acid salt to the fabrics, e.g., by contacting the fabrics with said antistatic and fabric softening compositions and allowing the fabrics to dry, e.g., by subjecting the fabrics to a tumbling action such as in a clothes dryer.

DETAILED DESCRIPTION INCLUSIVE OF THE PREFERRED EMBODIMENTS

The compositions of the invention comprise three essential ingredients: a lactic acid salt and an N,N-dialkyl-N,N-di-lower-alkylquaternary ammonium salt, which together comprise the antistatic component of the compositions, and a carrier for the antistatic component.

The lactic acid salt can be an alkali metal lactate such as sodium, potassium or lithium lactate, an alkaline earth metal lactate such as calcium or magnesium lactate, or ammonium lactate. Sodium lactate, being economical and readily available commercially, is a preferred salt.

The N,N-dialkyl-N,N-di-lower-alkylquaternary ammonium salt is represented by the formula:

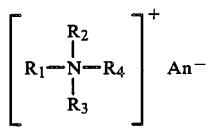

I where $R_1$ and $R_2$ are long chain alkyl groups containing from twelve to twenty-two carbon atoms; $R_3$ and $R_4$ are lower-alkyl groups containing from one to three carbon atoms; and $An^-$ is an anion, such as chloride, sulfate, methosulfate, ethosulfate, acetate, nitrate and phosphate. The cation in the quaternaries of formula I above includes, for example, N,N-dimethyl-N,N-ditallowammonium, where the $R_1$ and $R_2$ alkyl groups are derived from tallow and which contain principally from sixteen to eighteen carbon atoms; N,N-dihexadecyl-N,N-dimethylammonium; N,N-dioctadecyl-N,N-dimethylammonium; N,N-dihexadecyl-N,N-diethylammonium; N,N-dimethyl-N,N-distearylammonium and N,N-dicoconutalkyl-N,N-dimethylammonium. Preferred anions are chloride and methosulfate. A particularly preferred species of quaternary of formula I is N,N-dimethyl-N,N-distearylammonium methosulfate. Surprisingly, it has been found that when such combinations are applied to textile fabrics, they provide an antistatic effect far superior to that obtained by application of the same concentrations of either the quaternary ammonium salt alone or the lactic acid salt alone, the latter, as stated before, having been found by us to be completely ineffective.

The carrier used in preparing the compositions of the invention is selected from water, ethanol, propanol, isopropanol, straight and branched chain hydrocarbons having from two to six carbon atoms such as ethane, propane, butane, isobutane and hexane, and mixtures thereof. The antistatic component of the compositions, as well as any optional ingredients which may be included as described hereinafter, are preferably in solution in the carrier, but may be partially suspended therein. As will be appreciated, if a desired carrier or a component thereof normally exists as a gas at room temperature and pressure, compositions employing such a carrier are formulated under pressure, using conventional techniques, for dispensing from pressurized containers such as aerosol containers. Thus, the carrier or a component thereof which is an essential ingredient in the compositions of the invention, can, depending on the particular carrier chosen, also function as an aerosol propellant for the compositions of the invention.

The compositions of the invention may optionally be formulated with certain fabric softeners of the N-long chain alkylamido-lower-alkyl-N,N-di-lower-alkyl-N-$R_4'$-ammonium type having the formula:

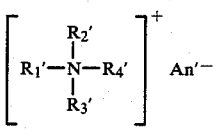

II where $R_1'$ is a long chain alkylamido-lower-alkyl group containing from ten to twenty carbon atoms in the long chain alkylamido moiety and from one to three carbon atoms in the lower-alkyl moiety; $R_2'$ and $R_3'$ are each lower-alkyl groups containing from one to three carbon atoms; $An'^-$ is an anion, such as chloride, sulfate, methosulfate, ethosulfate, acetate, nitrate and phosphate; and $R_4'$ is lower-alkyl having from one to three carbon atoms or benzyl or $R_4'$, together with the ammonium nitrogen atom and the anion $An'^-$, is a zwitterion group such as betaine. We have found that the resulting formulations not only retain the superior antistatic properties but also possess good fabric softening or conditioning properties. Thus fabrics treated with such formulations have little or no static cling and, in addition, have a good "feel" or "hand". The fabric conditioner of the N-long chain alkylamido-lower-alkyl-N,N-di-lower-alkyl-N-$R_4'$-quaternary ammonium type additionally serves as a dispersant for the quaternary ammonium compound of formula I as well as for any optional ingredients, as hereinafter described, which are included in the formulation.

The quaternary fabric conditioners of formula II include, for example, N-(3-isostearylamidopropyl)-N,N-dimethyl-N-ethylammonium ethosulfate, N-(3-isostearylamidopropyl)-N,N,N-triethylammonium ethosulfate, N-(3-isostearylamidopropyl)-N,N-dimethyl-N-benzylammonium chloride, N-(2-cocoamidoethyl)-N,N-dimethylammonium betaine or N-(3-cocoamidopropyl)-N,N-dimethylammonium betaine. Preferred conditioners of formula II are N-(3-isostearylamidopropyl)-N,N-dimethyl-N-ethylammonium ethosulfate and N-(3-isostearylamidopropyl)-N,N,N-triethylammonium ethosulfate.

The weight of the quaternary ammonium salt of formula I employed in the compositions of the invention, or the combined weight of quaternary ammonium salts of formula I and formula II when the latter additionally is employed, is in the range from around 0.25% to around 2.0%, preferably from around 0.35% to around 1.0%, based on the combined weight of the quaternary ammonium salt(s), the lactic acid salt and the carrier. The weight of the salt of lactic acid employed is in the range from around 0.06% to around 2.0%, preferably around 0.08% to around 0.7%, based on the combined weight of the quaternary ammonium salt(s), the lactic acid salt and the carrier.

The surprising superior antistatic properties possessed by the compositions of this invention are obtained by use of a certain ratio of the quaternary salt of formula I to the lactic acid salt, that ratio being from around 4:1 to around 1:1 parts by weight, a preferred ratio being from around 3:1 to around 1.5:1. When an N-long chain alkylamido-lower-alkyl-N,N-di-lower-alkyl-N-$R_4'$-quaternary ammonium salt of formula II is included as a fabric softener or conditioner along with the antistatic quaternary of formula I, desirably the ratio of the quaternary of formula I to the quaternary fabric conditioner of formula II is in the range from around 4:1 to around 1:1 parts by weight, a preferred ratio being around 3:1. Moreover, when fabric conditioners of formula II are included, it is essential that the ratio of the combined weight of the quaternaries of formulas I and II to the lactic acid salt be in the same range noted above, i.e. from around 4:1 to around 1:1 parts by weight, the preferred ratio being around 3:1.

The compositions of the invention are effective as antistatic agents over a wide pH range. Desirably the compositions should have a pH in the range from around 5.5 to around 9.5. When formulated for aerosol application, the compositions preferably will have a pH in the range from around 7.2 to 9 and more preferably around 7.9 to around 8.4, since compositions in these pH ranges are more compatible with the aerosol containers. The pH of the compositions can be adjusted, if necessary, to a desired value by addition to the compositions of one or more pH adjusters such as are well known in the art, for example, ammonium hydroxide, ammonium carbonate, an organic amine such as triethanolamine, and a simple organic acid such as acetic acid, citric acid, propionic acid and malic acid.

It is also contemplated that, in addition, optional ingredients such as antifoaming agents, preservatives, corrosion inhibitors (to prevent corrosion of the aerosol can when formulated for aerosol application) or fragrances and a deodorizer, the use of which ingredients is well known to those skilled in the art, may be incorporated in the formulations of the invention. Typically an antifoaming agent would be included in amounts up to about 1%, a corrosion inhibitor and a preservative in amounts up to about 1% each, a fragrance and a deodorizer in amounts up to about 5% each, the stated amounts being in percent by weight of the total composition. The exact amounts of such optional ingredients are not critical, the particular amount of each being chosen so as to provide the desired effect. It is only critical that the weightratio of the quaternaries of formula I and II to the lactate be in the range described hereinbefore.

In accordance with a preferred aspect of the invention, the compositions are formulated for aerosol application. When so formulated, the compositions are sealed in an aerosol container with an appropriate aerosol propellant. Suitable propellants include any of the well known hydrocarbons useful for such purpose, such as propane, isobutane or n-butane; halogenated hydrocarbons, such as trichloromonofluoromethane, dichlorodifluoromethane, dichloromonofluoromethane, chlorodifluoromethane, dichlorotetrafluoroethane, octafluorocyclobutane, monochlorotetrafluoroethane or monochlorodifluoroethane; and carbon dioxide or mixtures of some of the above. If a hydrocarbon is employed as propellant then, as noted hereinbefore, the hydrocarbon may also constitute, at least in part, the essential carrier for the compositions. When hydrocarbon propellants are used, it is sometimes advantageous to use them in combination with dimethyl ether which not only promotes the solution of otherwise difficultly soluble ingredients but also serves to moderate the pressure in the aerosol container. The amount of a particular propellant to be employed can be readily determined by one skilled in the art and will depend on the desired pressure profile for a particular composition.

Alternatively, the compositions of the invention can be applied to textile fabrics by spraying from conventional hand pump spray dispensers by sprinkling from conventional sprinkler type dispensers, or by contacting the fabric with a substrate impregnated with the composition. In the latter case, a convenient method for contacting the fabric with the impregnated substrate is by tumbling the fabric and substrate together in a clothes dryer, preferably without application of heat.

The compositions of the invention are used by applying them to the textile fabric, employing the application methods hereinbefore described, and then drying the fabric. Drying can be accomplished, for example, by hanging the treated fabric in ambient air for an appropriate period of time, or by tumbling the treated fabric in a clothes dryer, with or without the application of heat. The compositions may be sprayed or sprinkled onto the entire fabric surface or onto only a portion thereof. If applied only to a portion of the fabric, distribution of the composition throughout the entire body of the fabric can be effected, for example, by subjecting the treated fabric to a tumbling action such as the tumbling action of a clothes dryer, either with or without the application of heat.

The best mode of formulating and using the compositions of the invention will now be described so as to enable any person skilled in the art to make and to use the same.

EXAMPLES

In order to demonstrate the unexpected and superior antistatic properties of formulations prepared in accordance with the present invention in comparison with similar formulations lacking the particular essential combination of lactic acid salt with quaternaries of formulas I and II, various aerosol test formulations were prepared as follows:

| | % by Weight |
|---|---|
| **Formulations Prepared in Accordance with the Invention:** | |
| **FORMULATION 1** | |
| Concentrate: | |
| Distilled water | 99.00 |
| Hydrogenated ditallow dimethylammonium methosulfate | 0.75 |
| Sodium lactate | 0.25 |
| | 100.00 |
| Aerosol Formulation: | |
| Concentrate | 92.0 |
| Propellant A-46* | 8.0 |
| | 100.0 |
| **FORMULATION 2** | |
| Concentrate: | |
| Distilled water | 98.75 |
| Hydrogenated ditallow dimethylammonium methosulfate | 0.75 |
| Sodium lactate | 0.50 |
| | 100.00 |
| Aerosol Formulation: | |
| Concentrate | 92.0 |
| Propellant A-46 | 8.0 |
| | 100.0 |

-continued

| | % by Weight |
|---|---|
| **FORMULATION 3** | |
| Concentrate: | |
| Distilled water | 99.00 |
| Armosoft DA-3+ | 0.75 (0.375 active) |
| Sodium lactate | 0.25 |
| | 100.00 |
| Aerosol Formulation: | |
| Concentrate | 92.0 |
| Propellant A-46 | 8.0 |
| | 100.00 |
| **FORMULATION 4** | |
| Concentrate: | |
| Distilled water | 99.00 |
| Hydrogenated ditallow dimethylammonium methosulfate | 0.56 |
| N—(3-Isostearylamidopropyl)-N,N,N—triethylammonium ethosulfate | 0.19 |
| Sodium lactate | 0.25 |
| | 100.00 |
| Aerosol Formulation: | |
| Concentrate | 92.0 |
| Propellant A-46 | 8.0 |
| | 100.0 |
| **Formulations Prepared for Comparative Purposes** | |
| **FORMULATION 5** | |
| Concentrate: | |
| Distilled water | 99.25 |
| Hydrogenated ditallow dimethylammonium methosulfate | 0.75 |
| | 100.00 |
| Aerosol Formulation: | |
| Concentrate | 92.0 |
| Propellant A-46 | 8.0 |
| | 100.0 |
| **FORMULATION 6** | |
| Concentrate: | |
| Distilled water | 99.25 |
| Sodium lactate | 0.75 |
| | 100.00 |
| Aerosol Formulation: | |
| Concentrate | 92.0 |
| Propellant A-46 | 8.0 |
| | 100.0 |
| **FORMULATION 7** | |
| Concentrate: | |
| Distilled water | 99.25 |
| Armosoft DA-3 | 0.75 (0.375 active) |
| | 100.00 |
| Aerosol Formulation: | |
| Concentrate | 92.0 |
| Propellant A-46 | 8.0 |
| | 100.0 |
| **FORMULATION 8** | |
| Concentrate: | |
| Distilled water | 99.25 |
| Hydrogenated ditallow dimethylammonium methosulfate | 0.375 |
| N—(3-Isostearylamidopropyl)-N,N,N—triethylammonium ethosulfate | 0.375 |
| | 100.00 |
| Aerosol Formulation: | |
| Concentrate | 92.0 |
| Propellant A-46 | 8.0 |
| | 100.0 |
| **FORMULATION 9** | |
| Concentrate: | |
| Distilled water | 99.25 |

-continued

| | % by Weight |
|---|---|
| Hydrogenated ditallow dimethylammonium methosulfate | 0.56 |
| N—(3-Isostearylamidopropyl)-N,N,N—triethylammonium ethosulfate | 0.19 |
| | 100.00 |
| Aerosol Formulation: | |
| Concentrate | 92.0 |
| Propellant A-46 | 8.0 |
| | 100.0 |

*A commercially available 85/15 blend by weight of isobutane and propane.
+Mixture (1:1) of hydrogenated ditallow dimethylammonium methosulfate and fatty acid ester available from Armak Company, McCook, IL

Antistatic Testing

The antistatic properties of each of the above test formulations, as well as a distilled water spray which served as a control, were determined using the following procedure.

Test swatches of wool, DACRON®, ORLON® and nylon, each measuring 6"×6", were sprayed to dampness with the test formulations, then hung up to air dry for around twelve hours. The test swatches were then hung in a humidity chamber, at a relative humidity of 20–30%, for twenty-four hours, and each was then rubbed briskly for about six strokes on a polystyrene surface to induce an electrostatic charge on the fabrics. The static charge on each of the fabric samples was then determined immediately using a Simco Electrostatic Locator (Model Type SS-2), the values (expressed in volts) were recorded, and fifteen seconds later a second determination of the electrostatic charge was made and recorded for each sample. Thus the first determination provides a measure of the ability of a treated fabric to resist induction of an electrostatic charge, and the second determination provides a measure of the treated fabric to dissipate a charge once induced. The results so obtained using each of the above-described test formulations are set forth in Table A below, the initial electrostatic voltage readings being given in the columns headed "1" in each instance and the readings obtained fifteen seconds later being given in the columns headed "2". A distilled water spray served as a control.

TABLE A

| Test Formulation | Electrostatic Charge in Volts | | | | | | | |
|---|---|---|---|---|---|---|---|---|
| | Wool | | DACRON | | ORLON | | Nylon | |
| | 1 | 2 | 1 | 2 | 1 | 2 | 1 | 2 |
| Control | >5000 | >5000 | >5000 | >5000 | >5000 | >5000 | >5000 | >5000 |
| 1 | 5000 | 3000 | <100 | <100 | 4500 | 200 | <100 | <100 |
| 2 | 1800 | <100 | <100 | <100 | <100 | <100 | <100 | <100 |
| 3 | <100 | <100 | <100 | <100 | <100 | <100 | <100 | <100 |
| 4 | <100 | <100 | <100 | <100 | <100 | <100 | <100 | <100 |
| 5 | 3500 | 3000 | <100 | <100 | 4000 | 200 | 1200 | 700 |
| 6 | >5000 | >5000 | >5000 | >5000 | >5000 | >5000 | >5000 | >5000 |
| 7 | 3500 | 1500 | <100 | <100 | <100 | <100 | <100 | <100 |
| 8 | <100 | <100 | <100 | <100 | <100 | <100 | <100 | <100 |
| 9 | 3500 | 1500 | <100 | <100 | <100 | <100 | <100 | <100 |

These results show the surprising improvement in antistatic properties obtained by incorporation of a lactic acid salt with the quaternary of formula I alone or in combination with a quaternary of formula II in accordance with the present invention. Thus, a formulation of a quaternary of formula I with sodium lactate in a ratio of 3:1 (FORMULATION 1) shows a substantial improvement over a formulation containing the quaternary alone (FORMULATION 5) against nylon, and a formulation in which the quaternary:sodium lactate ratio is 1.5:1 (FORMULATION 2) shows a very significant improvement over the formulation of the quaternary alone (FORMULATION 5) against wool, ORLON® and nylon. The formulation of sodium lactate alone (FORMULATION 6) is seen to be completely ineffective against all fabric samples. Equally significant improvement in antistatic properties against wool of a combination of another quaternary of formula I (Armosoft DA-3) with sodium lactate in a ratio of 1.5:1 is seen by comparison of the results obtained with FORMULATION 7 (the quaternary of formula I alone) and FORMULATION 3 (the quaternary and sodium lactate at a 1.5:1 ratio). Improvement of comparable magnitude against wool was also demonstrated by comparing the results obtained with a formulation containing a combination of quaternaries of formulas I and II (FORMULATION 9) and a formulation containing the same quaternaries in combination with sodium lactate at a ratio of 3 parts quaternaries I and II and one part sodium lactate (FORMULATION 4).

Based on the results obtained with the above-described test formulations, a typical commercial preparation (FORMULATION 10) containing N,N-dimethyl-N,N-distearylammonium methosulfate (VARISOFT® 137, Sherex Chemical Company Inc., Dublin, OH; 90% solids in isopropanol, typical long chain alkyls distribution: myristyl 5%, palmityl 30%, stearyl 65%), N-(3-isostearylamidopropyl)-N,N-dimethyl-N-ethylammonium ethosulfate (JORDAQUAT® 522, min. 85% active, Jordan Chemical Company, Folcroft, PA), sodium lactate (obtained as 60% active from Patco Cosmetic Products, C. J. Patterson Co., Kansas City, MO) and, as additional ingredients, a fragrance, a corrosion inhibitor (Q.A.I., 2-hydroxypropyl nitrite, Classic Chemical, Arlington, TX), an antifoaming agent (SWS Emulsion Q-91, 30% dimethylsiloxane on a silica matrix, SWS Silicones Inc., Adrian, MI), a preservative (GLYDANT™, 55% 1,3-dimethyl-5,5-dihydroxymethylhydantoin, Glyco Chemicals, Inc., Greenwich, CT), and ammonium carbonate and ammonium hydroxide to provide a pH of 8.2 was formulated as follows. A concentrate was prepared by adding the VARISOFT® 137 to distilled water and heating the resulting mixture to around 70° C. with agitation. The mixture was then cooled, with agitation, to produce a fine dispersion of the quaternary in water. When the temperature was below around 30° C., a fragrance dissolved in the JORDAQUAT 522 was added with agitation followed by the remaining ingredients. The concentrate and a final aerosol formulation prepared therefrom, were thus constituted as follows:

| FORMULATION 10 | | |
|---|---|---|
| Concentrate: | | |
| VARISOFT ® 137 | 0.62 | (0.56 active) |
| JORDAQUAT ® 522 | 0.22 | (0.19 active) |
| Fragrance | 0.15 | |
| Sodium lactate (60%) | 0.41 | (0.25 active) |
| Q.A.I. | 0.20 | |
| SWS Emulsion Q-91 | 0.10 | (0.03 active) |
| GLYDANT TM | 0.20 | (0.11 active) |
| Ammonium carbonate | 0.05 | |
| Ammonium hydroxide (30%) | 0.20 | (0.06 active) |
| Distilled water | q.s. | |
| | 100.00 | |
| Aerosol Formulation: | | |
| Concentrate | 92.0 | |
| Propellant A-46 | 8.0 | |
| | 100.0 | |

The antistatic properties of FORMULATION 10 were determined using the hereinbefore described antistatic test procedure. The results are set forth in Table B.

TABLE B

| Test | Electrostatic Charge in Volts | | | | | | | |
|---|---|---|---|---|---|---|---|---|
| Formu- | Wool | | DACRON | | ORLON | | Nylon | |
| lation | 1 | 2 | 1 | 2 | 1 | 2 | 1 | 2 |
| | <100 | <100 | <100 | <100 | <100 | <100 | <100 | <100 |

These results demonstrate the outstanding antistatic properties obtained by a typical commercial formulation prepared in accordance with the invention.

The preceding embodiments of the invention are provided for illustrative purposes so as to enable any person skilled in the art to practice the same. It should be understood that other expedients well known to those skilled in the art may be employed without departing from the spirit of the invention.

We claim:

1. An antistatic fabric conditioner composition comprising:

(a) an antistatic-fabric conditioning agent comprising:

(i) a quaternary ammonium salt component selected from the group consisting of a quaternary ammonium salt having the formula:

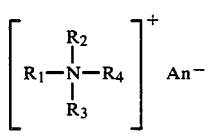

I wherein $R_1$ and $R_2$ each independently is long chain alkyl having from twelve to twenty-two carbon atoms, $R^3$ and $R^4$ each independently is lower-alkyl having from one to three carbon atoms, and $An^-$ is an anion; and a combination of the salt of formula I with a quaternary ammonium salt of the formula:

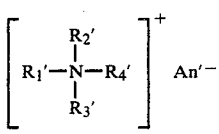

II wherein $R_1'$ is long chain alkylamido-lower-alkyl having from ten to twenty carbon atoms in the long chain alkylamido moiety and from one to three carbon atoms in the lower-alkyl moiety, $R_2'$ and $R_3'$ each independently is lower-alkyl having from one to three carbon atoms, $An'^-$ is an anion, and $R_4'$ is lower-alkyl having from one to three carbon atoms or benzyl, or $R_4'$, together with the ammonium nitrogen atom and $An'^-$, forms a zwitterion group; and (ii) a lactic acid salt selected from the group consisting of alkali metal lactate, alkaline earth metal lactate and ammonium lactate; and (b) a carrier for the antistatic-fabric conditioning agent selected from the group consisting of water, ethanol, propanol, isopropanol, an aliphatic hydrocarbon having from two to six carbon atoms, and combinations thereof;

wherein the weight ratio of (i) to (ii) and of the salt of formula I to the salt of formula II each independently is from around 4:1 to around 1:1.

2. A composition according to claim 1 which, relative to the combined weight of the antistatic-fabric conditioning agent and the carrier, contains from around 0.25 to around 2.0 weight percent of the quaternary ammonium salt component; from around 0.06 to around 2.0 weight percent of the lactic acid salt; and the balance to 100 weight percent carrier.

3. A composition according to claim 1 wherein the lactic acid salt is alkali metal lactate.

4. A composition according to claim 3 adapted for aerosol application wherein the carrier consists essentially of a combination of water and a blend of isobutane and propane.

5. A composition according to claim 4 wherein the weight ratio of isobutane to propane is 85:15 and the concentration of the blend is around 8 weight percent relative to the weight of the composition.

6. A composition according to claim 5 wherein the antistatic-fabric conditioning agent comprises N,N-dimethyl-N,N-distearylammonium methosulfate, N-(3-isostearylamidopropyl)-N,N-dimethyl-N-ethylammonium ethosulfate and sodium lactate; and the weight ratio of the combined quaternary ammonium salts to the sodium lactate and of the quaternary ammonium methosulfate to the quaternary ammonium ethosulfate each is around 3:1.

7. A method of reducing or inhibiting the accumulation of an electrostatic charge on a textile fabric which comprises applying to the fabric an effective amount of an antistatic-fabric conditioning agent comprising:

(i) a quaternary ammonium salt component selected from the group consisting of a quaternary ammonium salt having the formula:

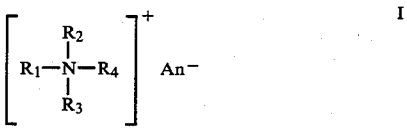

I wherein $R_1$ and $R_2$ each independently is long chain alkyl having from twelve to twenty-two carbon atoms, $R_3$ and $R_4$ each independently is lower-alkyl having from one to three carbon atoms, and $An^-$ is an anion; and a combination of the salt of formula I with a quaternary ammonium salt of the formula:

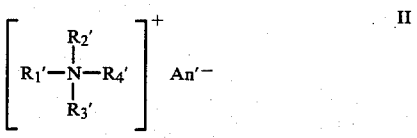

II wherein $R_1'$ is long chain alkylamido-lower-alkyl having from ten to twenty carbon atoms in the long chain alkylamido moiety and from one to three carbon atoms in the lower-alkyl moiety, $R_2'$ and $R_3'$ each independently is lower-alkyl having from one to three carbon atoms, $An'^-$ is an anion, and $R_4'$ is lower-alkyl having from one to three carbon atoms or benzyl, or $R_4'$, together with the ammonium nitrogen atom and $An'^-$, forms a zwitterion group; and (ii) a lactic acid salt selected from the group consisting of alkali metal lactate, alkaline earth metal lactate and ammonium lactate;

wherein the weight ratio of (i) to (ii) and of the salt of formula I to the salt of formula II each independently is from around 4:1 to around 1:1.

8. A method according to claim 7 wherein the lactic acid salt is alkali metal lactate.

9. A method according to claim 8 wherein the antistatic-fabric conditioning agent comprises N,N-dimethyl-N,N-distearylammonium methosulfate, N-(3-isostearylamidopropyl)-N,N-dimethyl-N-ethylammonium ethosulfate and sodium lactate; and the weight ratio of the combined quaternary ammonium salts to the sodium lactate and of the quaternary ammonium methosulfate to the quaternary ammonium ethosulfate each is around 3:1.

10. A method of treating a textile fabric to reduce or inhibit the accumulation of an electrostatic charge thereon which comprises applying to the fabric an effective amount of an antistatic-fabric conditioning composition comprising:

(a) an antistatic-fabric conditioning agent comprising:

(i) a quaternary ammonium salt component selected from the group consisting of a quaternary ammonium salt having the formula:

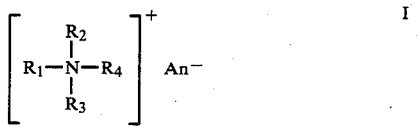

I wherein $R_1$ and $R_2$ each independently is long chain alkyl having from twelve to twenty-two carbon atoms, $R_3$ and $R_4$ each independently is lower-alkyl having from one to three carbon atoms, and $An^-$ is an anion; and a combination of the salt of formula I with a quaternary ammonium salt of the formula:

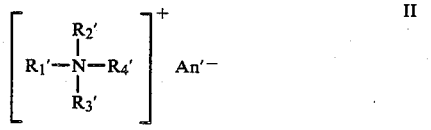

II wherein $R_1'$ is long chain alkylamido-lower-alkyl having from ten to twenty carbon atoms in the long chain alkylamido moiety and from one to three carbon atoms in the lower-alkyl moiety, $R_2'$ and $R_3'$ each independently is lower-alkyl having from one to three carbon atoms, $An'^-$ is an anion, and $R_4'$ is lower-alkyl having from one to three carbon atoms or benzyl, or $R_4'$, together with the ammonium nitrogen atom and $An'^-$, forms a zwitterion group; and (ii) a lactic acid salt selected from the group consisting of alkali metal lactate, alkaline earth metal lactate and ammonium lactate; and (b) a carrier for the antistatic-fabric conditioning agent selected from the group consisting of water, ethanol, propanol, isopropanol, an aliphatic hydrocarbon having from two to six carbon atoms, and combinations thereof;

wherein the weight ratio of (i) to (ii) of the salt of formula I to the salt of formula II each independently is from around 4:1 to around 1:1; and drying the fabric.

11. A method according to claim 10 whereby the fabric is dried by subjecting it to a tumbling action in a clothes dryer.

12. A method according to claim 10 wherein the lactic acid salt is an alkali metal lactate.

13. A method according to claim 12 wherein the antistatic-fabric conditioning composition is applied to the fabric as an aerosol spray from a pressurized container and wherein the carrier consists essentially of a combination of water and a blend of isobutane and propane.

14. A method according to claim 13 wherein the weight ratio of isobutane to propane is 85:15 and the concentration of the blend is around 8 weight percent relative to the weight of the composition.

15. A method according to claim 14 wherein the antistatic-fabric conditioning composition comprises N,N-dimethyl-N,N-distearylammonium methosulfate, N-(3-isostearylamidopropyl)-N,N-dimethyl-N-ethylammonium ethosulfate and sodium lactate; and the weight ratio of the combined quaternary ammonium salts to the sodium lactate and of the quaternary ammonium methosulfate to the quaternary ammonium ethosulfate each is around 3:1.

* * * * *